US007195677B2

(12) United States Patent
Morrisey-Hawkins

(10) Patent No.: US 7,195,677 B2
(45) Date of Patent: Mar. 27, 2007

(54) WIPE DISPENSER AND METHOD FOR DISPENSING WIPES

(76) Inventor: Priscilla Morrisey-Hawkins, 8101 Schrider St., #5, Silver Spring, MD (US) 20910

( * ) Notice: Subject to any disclaimer, the term of this patent is extended or adjusted under 35 U.S.C. 154(b) by 100 days.

(21) Appl. No.: 11/035,356

(22) Filed: Jan. 12, 2005

(65) Prior Publication Data

US 2005/0145642 A1 Jul. 7, 2005

Related U.S. Application Data

(63) Continuation-in-part of application No. 10/195,587, filed on Jul. 15, 2002, now abandoned.

(51) Int. Cl.

| | |
|---|---|
| ***B08B 7/00*** | (2006.01) |
| ***A47L 13/00*** | (2006.01) |
| ***B65D 71/00*** | (2006.01) |
| ***B65H 1/00*** | (2006.01) |
| ***B26F 3/02*** | (2006.01) |

(52) U.S. Cl. ..... 134/6; 15/231; 206/233; 221/63; 225/6; 83/648

(58) Field of Classification Search ..... 83/648, 83/649, 922; 225/39, 100, 56, 57, 76, 77, 225/6, 23, 15, 16, 26; 221/64, 92, 282, 303, 221/309, 45, 34, 61, 63; 206/204, 233, 812, 206/409, 494; 15/231; 134/6
See application file for complete search history.

(56) References Cited

U.S. PATENT DOCUMENTS

| | | | | |
|---|---|---|---|---|
| 5,542,568 | A * | 8/1996 | Julius | 221/63 |
| 5,996,797 | A * | 12/1999 | Flaig | 206/494 |
| 6,098,836 | A * | 8/2000 | Gottselig | 221/45 |
| 6,363,991 | B1 * | 4/2002 | Huang | 156/577 |
| 2002/0162848 | A1 * | 11/2002 | Na | 221/63 |

* cited by examiner

*Primary Examiner*—Kenneth E. Peterson
*Assistant Examiner*—Phong Nguyen
(74) *Attorney, Agent, or Firm*—Dodds and Associates; John Dodds; Susanne Somersalo

(57) ABSTRACT

The wipe-dispensing device comprises a dispenser or container that keeps wipes isolated from the exterior of the device. The wipes are kept in the interior compartment of the dispenser or container. The top or lid of the device isolates the wipes in the interior compartment from the exterior of the device. This top or lid also secures the container from air, and seals the interior and exterior compartments of the device. Wipes are exposed when user manually presses a button on the lid or activates a sliding door which in turn shall expose the wiping surface of the wipe inside of the container. Therefore, the rest of the wipes are not exposed to the exterior, only the wipe that is in use. User may manually handle the device, expose the wipe for cleaning the desired surface, and thereafter user may pull the wipe and detach it from the device by tearing it off with a cutter slot of the device.

20 Claims, 4 Drawing Sheets

1
2
3
4
5
6
7
8
9
11
12
13
14
17
18
19
20
21

WIPE DISPENSER AND METHOD FOR DISPENSING WIPES

This application is a Continuation-In-Part of application Ser. No. 10/195,587 filed Jul. 15, 2002 now abandoned.

BACKGROUND & CROSS REFERENCES TO RELATED APPLICATIONS

Not applicable to this application.

BACKGROUND: FEDERALLY SPONSORED RESEARCH

The invention subject matter of the present application was not a recipient of any federal support for its research and development.

REFERENCE TO MICROFICHE APPENDIX

Not applicable to this application.

BACKGROUND: FIELD OF INVENTION

This invention relates to the field of wipe dispensers, most particularly to a lightweight, portable, disposable, and handheld wipe dispensing device that isolates the cleaning wipes from the exterior of the dispenser until user exposes the wipe to said exterior for cleaning a particular surface. In addition, this application describes a novel method for dispensing wipes, for user may hold the device by hand, manually manipulate the device to clean a desired surface with the device without having to manually manipulate or enter into contact with the wipe itself until the cleaning process or disposal of the wipe has been completed. Therefore, by means of this novel method, a wipe is kept inside the device without having contact neither with the exterior of the device or area outside of the device, nor with a human hand.

When the device's sliding door or window is opened, the wipe is exposed for cleaning the chosen surface. User may manipulate the device to clean the desired surface, pull the wipe and tear it off from the cutter slot placed in the second compartment (also referred to as exterior compartment) of the device. Therefore, the remaining wipes inside the dispenser have not been in contact with the exterior, and therefore their disinfecting properties remain intact.

Furthermore, the invention may be used for hygienic and disinfecting purposes.

Most wipe dispensing devices present in the prior art are containers that have an opening, enabling the consumer to manually remove the wipe from said device and subsequently disinfect and/or clean the desired surface. Therefore, user must place the wipe into contact with his or her hand and with the surroundings before the cleaning process. Due to this manual contact, the disinfecting properties of a wipe may be altered, and the disinfecting and cleaning may not be effective as intended. In addition, no device in the prior art discloses the Morrisey-Hawkins invention. There is no other wipe dispensing device and method for dispensing wipes in the prior art, particularly in the field of disinfecting wipes, that comprises a handheld wipe dispensing device and method for dispensing wipes with the characteristics described herein under. Moreover, the Morrisey-Hawkins invention is a novel and useful device that comprises a lightweight, portable, and disposable handheld wipe dispenser that isolates the wipes from the exterior of the device, therefore maintaining their disinfecting properties intact until user has finalized cleaning and disposes of the wipe.

The Morrisey-Hawkins invention has been designed primarily to be used as: (i) a handheld, portable, lightweight and disposable wipe dispenser that seals the wipe inside the container, and enables user to clean surfaces without getting the wipe into contact with his or her hands prior to the cleaning process; and (ii) a method for dispensing wipes wherein user manually grabs the device, manipulates the button on the flappable door and opens the device's door or window which has slid on the tracks on the flappable door, exposing the wipe, and cleans a desired surface with the exposed wipe. After the desired surface is cleaned, user manipulates the button to close the door or window. The bottom section is secured to the top section of the device by the lid, the door holes or indentures which is part of the exterior compartment, as well as by the air closure hole, placing the air closure of the bottom of the device into the hole or indenture of the lid of the top section of the device, thereby sealing the cutter slot and the device. This method allows the wipes to be kept inside the container and prevents the wipes from entering into contact with the exterior prior to user opening the sliding door or window and exposing the wipe for the cleaning process. After the desired surface is cleaned and if the wipe is still exposed, user may also tear off the wipe at the device's cutter slot, remove the wipe from the device, and close the device's door or window by manipulating the button, thereby sealing the device. This allows the remaining wipes to be kept inside the device without having been exposed or in contact with the exterior of the device, therefore keeping its hygienic properties.

BACKGROUND: DISCUSSION OF PRIOR ART

There are several wipe dispensers and systems for dispensing wipes in the prior art. Nevertheless, none of the inventions in the prior art disclose the device and method subject matter of the present application. For example, U.S. Pat. No. 3,967,756 (Barish, 1976) describes a Wet Wipe Dispenser in which user removes the tissue from the upper section of the dispenser. In addition, U.S. Pat. No. 5,560,514 (Frazier, 1996) describes a Wet Wipe Dispensing Nozzle With Rotatable Port. This patent refers to a center flow dispenser for dispensing saturated wipers including a dispensing nozzle affixed to the container of wet wipes. Furthermore, U.S. Pat. No. 5,785,179 (Buczwinski, 1998) discloses a Container for Wet Wipes Having an Improved Closure Mechanism; U.S. Pat. No. 6,056,235 (Brozinsky, 2000) pertains to a Refillable Dispenser For Replacing Standard Roll of Toilet Tissue with Roll of Pre-Moist Wipes; U.S. Pat. No. 6,092,690(Bitowft et al, 2000) illustrates a Wet Wipe Container Having a Hinged Cover used for a stack of moist wipes; U.S. Pat. No. 6,158,614 (Haines et al, 2000) refer to a Wet Wipe Dispenser With Refill Cartridge; U.S. Pat. No. 6,189,730 B1 (McClymonds, 2001) refers to a Wet Towelette and Dry Towel Dispenser Apparatus which may be wall or door mounted and which may hold dry and wet towels; U.S. Pat. No. 6,269,969 B1 (Huang et al, 2001) disclose a Wet Wipes Container with Improved Closure; U.S. Pat. No. 6,269,970 B1 (Huang et al, 2001) describes a Wet Wipes Container Having a Tear Resistant Lid; and U.S. Pat. No. 6,346,153 (Lake et al, 2002) discloses a Wet or Dry Web Dispenser. This dispenser provides a dry web in which a liquid can be introduced when desired, thus being able to deliver a dry or a wet wipe to user at his or her preference. This patent does not disclose the Morrisey-Hawkins invention.

With respect to the method described hereinunder, it is a new and useful method for dispensing wipes not previously disclosed in the prior art. U.S. patent application No. US2002/0005452 A1 describes a System and Method for Refilling a Dispenser (Romme et al); U.S. patent application No. US 2002/0023932 A1 disclose a System for Dispensing Plurality of Wet Wipes (Faulks et al); U.S. patent application No. US2002/0036208 A1 (Faulks et al) refers to a Wipes Dispensing System; U.S. patent application No. US 2001/0039786 describe a Method for Providing Wet Wipes (Romme et al); however, none of the referred applications disclose the Morrisey-Hawkins method.

U.S. Pat. No. 5,718,353 (Kanfer et al) describes a Towelette Dispensing Closure Assembly. This invention is different from the one claimed herein under because it is not a handheld device that allows user to clean a surface without touching the wipes. On the contrary, user of the Kanfer et al must manually remove the tissue from the dispenser in order to clean a surface.

U.S. Pat. No. 6,213,343 (Damikolias) pertains to a portable sterile bandage dispenser. This invention is clearly different from the one claimed hereinunder, for it is to be used for bandages (while the present invention for wipes), and is not meant for handheld use, unlike the present invention.

U.S. Pat. No. 6,176,409 B1 (Lee) is for an adhesive tape dispenser; and U.S. Pat. No. 6,065,519 (Lee) is for an automatic drawing and cutting device for adhesive tape dispenser. These inventions are also clearly different from the one claimed in this application.

U.S. Pat. No. 4,535,912 (Bonk) describes a Pre-Moistened Towelette Dispenser that is different from the invention subject of this application. The main difference with the Bonk invention is that the Morrisey-Hawkins invention is a handheld wipe dispenser, that is meant to be lightweight, portable and disposable; while the Bonk dispenser is not claimed to be handheld, nor a portable device. The significant difference with this invention and the novelty of the Morrisey-Hawkins invention is the latter requires manual use (for it to be handheld), and therefore, user does not need to touch the wipes. Thus, since the wipes have had no contact with any external surface, these have kept their hygienic properties, and are hence, fully clean. Second, the Morrisey-Hawkins invention is also disposable. Third, in the Morrisey-Hawkins invention, the wipes are used while they are still inside the dispenser, while Bonk's invention requires the wipes to be removed from the dispenser by user. These characteristics make these two inventions clearly different from each other.

Moreover, the present invention and the one described in Bonk have different elements. The Morrisey-Hawkins invention has a top section comprising a detachable lid that is secured to the bottom section of the device and that may be removed for refilling the device with wipes. In order for user to use the device for cleaning a surface, user must open the sliding door or window by manipulating the device's button, exposing the wipe to the exterior of the device. Thereafter, user manually holds the device, lifts it, manipulates it so that exposed wipes enter into contact with the surface that user intends to clean. Therefore, unlike the Bonk invention, user does not have to open the lid in order to remove a wipe for use.

The Bonk invention has a double lid that includes hinges and a feed slot. The double lid in Bonk must be used in order for user to have access to the tissue and to pull the tissue for use, unlike the invention claimed in this application.

The Morrisey Hawkins invention includes two compartments that are part of the bottom section of the claimed wipe dispenser device, and the first compartment (or interior compartment) holds a supply of wipes and the second compartment (or exterior compartment) exposes the wipes to an opening. The Bonk invention does not have two compartments that are part of the bottom section of the device, but rather, it has two lids and a pouch. There is no pouch or bag in the invention subject of this application. The invention disclosed herein has a sliding door or window at the exterior compartment of the invention allowing exposure of the wipe to the exterior of the device when the door or window is open. Unlike applicant's invention, the Bonk invention has a lid that needs to be removed for user to remove a wipe.

The Morrisey Hawkins invention has a thread slot in the bottom section of the invention, and it allows the tissue or wipes to follow a path or pass from the interior compartment to the exterior compartment of the device for use of the tissue or wipes. The Bonk invention has not claimed a thread slot, and has an opening which is created by the pouch (unlike the invention of applicant).

The claimed invention includes an air closure that snaps on into an indenture or hole on the lid and seals the cutter slot and the device, thus not permitting air to enter into contact with the tissue. The invention also has a sliding door or window that when opened exposes the wipes or tissue to the exterior of the device. The Bonk invention does not have the sliding door or window and an air closure that snaps on the lid and seals a cutter slot. The Bonk invention has a double lid which is not an air closure as claimed for the Morrisey Hawkins invention.

In addition, most of the aforementioned devices, methods or systems are intended for user to have immediate contact with the wipe or towelette prior to performing the cleaning or disinfecting process, unlike the invention subject of this application. Moreover, the abovementioned methods disclosed in the prior art do not require user to open a section of the dispenser in order to have the wipe available and to manually hold the device to clean the desired surface. None of the referred methods prevent the wipe to have contact with the exterior surrounding the dispenser, including air, and therefore do not effectively protect the disinfecting properties of the wipes from external materials and surroundings. Therefore, by means of this method, user will be able to clean or disinfect a surface without touching the wipe, and may dispose of the same after cleaning has concluded. Once the dispenser's sliding door is closed, the wipes will once again be isolated and protected from any exterior air, substances and materials, preserving its disinfecting properties. In conclusion, related devices and methods in the prior art do not disclose the claimed Morrisey-Hawkins device and method.

SUMMARY

The present invention is a handheld wipe dispenser device and method for dispensing wipes. The wipe-dispensing device comprises a lightweight, portable and disposable handheld dispenser or container that keeps wipes isolated from the exterior of the device. The wipes are kept in the compartments of the dispenser or container. The top section of the device isolates the wipes in the compartments from the exterior area. The lid also secures the container from air, and seals the interior and exterior compartments of the device. Wipes are exposed when user manually presses a button on the lid or activates a sliding door or window which in turn shall expose the wiping surface of the wipe inside of the container. Therefore, the rest of the wipes are not exposed to the exterior, only the wipe that is in use. User manually handles the device, manipulates the button which slides on the device's track and lid slit, opens the sliding door or window thereby exposing the wipe to the exterior, manipulates the device and cleans the desired surface. After cleaning has been completed, user may manipulate the button by pressing it or having it slide on the track slit, thereby closing the sliding door or window, and the opening. The bottom section and top section are secured to each other by placing the door snaps on the flappable door in the holes or indentures in the exterior compartment of the device, and place the air closure in the hole or indenture on the lid in order to completely seal the device. Alternatively, user may pull the wipe and detach it from the device by tearing it off with a cutter slot on the exterior compartment of the device and thereafter close the sliding door or window, thereby sealing the device. The cutting edge of the cutter slot cuts the wipes when user pulls the wipe and manipulates it at an angle that will allow the cutter slot to cut it. The cutter slot to cut the wipes may be of various shapes and materials; one embodiment being a razor edge. The remaining wipes are still isolated from the exterior of the container or dispenser for an air closure snugly snaps onto a hole or indenture on the lid, and over to the top of the cutter slot sealing off the air and exterior and keeping the wipes isolated.

OBJECTS & ADVANTAGES

Several advantages of the Morrisey-Hawkins invention are disclosed in the present application. The objects and advantages of this wipe dispenser and method for dispensing wipes disclosed herein include but are not limited to providing the wipe dispensing field and field of methods for dispensing wipes with a novel handheld device that will enable user to clean a desired surface with an intact wipe (without prior exposure to the exterior of the device). Furthermore, this invention has the advantage of being a novel and useful method for dispensing device providing user with intact wipes with no prior contact with the exterior of the container or dispenser.

The invention claimed herein under has the characteristic of being handheld, lightweight, portable, and disposable, which is clearly an advantage over the devices in the prior art.

Other objects, features and advantages will become apparent from a consideration of the following detailed description and from the accompanying drawings and the claims of the invention.

In view of the foregoing, various objects and advantages of the present invention include the following:

1. One object of the present invention is to provide a handheld device that isolates wipes from the exterior of the device. This will allow user to manually handle the device and clean a desired surface with a completely clean wipe. Therefore, this invention provides increased hygiene for its user.
2. In addition, another object is to provide a wipe container or dispenser for wipes in general, such as but not limited to wet, moist, dry wipes, scented, unscented, and of various cleaning properties.
3. Another object of the present invention is to provide a novel method for dispensing wipes in which the wipe is isolated from the dispensing device to cleaning the surface. This provides increased hygiene for user.
4. Another object of this invention is to be a lightweight and portable device, thus having the advantage that user can easily manipulate it to clean the desired surface and carry it with him or her to other places. For example, this lightweight and portable device may be carried in a purse, or kept in an automobile compartment, or in an office drawer. Since it is lightweight and portable, user could easily transport it to his or her car, clean surfaces there, or clean surfaces in his or her home or office. Thus, it is an object and advantage for this invention to be lightweight and portable, making it easy for user to carry it and use it in different surfaces.
5. Another object and advantage of this invention is that it may be disposable.
6. This invention has further advantages such as being a hygienic cleansing device that may be used in distinct surfaces. It may be used for cleaning items at user's home or office environments, such as but not limited to telephones, cellular or mobile phones, telephone receivers, phone ear piece, phone base, desk top, speakers, computer or typewriter keyboards, computer mouse, door knobs, desk accessories (such as scissors, staples, tape dispenser), refrigerators, refrigerator handles, counter tops, sinks, cabinet handles or knobs, remote controls for electronic appliances. In addition, this device may also be used for user to cleanse his or her hands.
7. Another object and advantage of this invention is that due to the use of the cutter slot, user is able to clean a desired surface and thereafter pull and tear off the dirty wipe, without entering into contact with the rest of the supply of wipes. User will not be subject to by mistake pulling more than one wipe at a time (including clean, unused wipes) because the cutter slot will allows for tearing off the dirty wipe. This enables user to keep the clean supply of wipes, and not waste any of them by mistake.

DESCRIPTION OF THE INVENTION

The invention subject of this application comprises a handheld wipe dispenser device and method for dispensing wipes. The structural features of the invention comprise:

A dispenser or container that includes a top section 1 and a bottom section 10.

The top section 1 consists of:

(a) A detachable top or lid 2.

(b) A lid slit 21 that is an opening that when aligned with the track slit 20 allows for passage of the button and a back and forth movement of the button 12 and door 6 when pressed or slid by user. When the button 12 passes through the track slit 20 and lid slit 21 it allows the door 6 to slide on the track slit 21 to open or close the opening 5.

(c) An indenture or hole 14 for air closure.

The bottom section 10 consists of:

(a) a first compartment 3 that comprises an interior compartment 3 being a moisture impermeable section for housing or to hold a supply of wipes 16 or tissues that follow a path to and in the second compartment 4.

(b) A supply of wipes 16 or tissues in the interior compartment 3.

(c) Two indentures or holes 18 in the interior compartment 3, each indenture or hole 18 located at the opposite side of each other.

The exterior compartment 4 includes:

(a) A thread slot 7 from the interior compartment to the exterior compartment directing the wipe 16 to pass an opening 5 to expose a wipe 16, (b) An opening 5 that comprising a section with a window or sliding door 6 which exposes the wipe 16 to a desired surface. This opening 5 may include but is not limited to a sliding door 6 or window. When this door 6 or window is opened, the wipe 16 is exposed to the exterior for cleaning a desired surface.

(c) A sliding door 6 or window that opens and closes the opening 5 allowing exposure of the wipe 16 or sealing of the opening 5.

(d) A flappable door 13 that is semi-detached from the bottom section 10 and having an upper section and a lower section.

(e) A button 12 on the flappable door 13 that sits on tracks 19 or reels, or that may be located on the lid 2. This button 12 shall activate the sliding door 6 if pressed or slid by user.

(f) Tracks 19 or reels on the flappable door 13. The bottom track 19 supports and guides the movement of the bottom section of the flappable door 13, and the top track 19 supports and guides the movement of the top section of the flappable door. The sliding door 6 rests in the tracks 19 or reels. When the button 12 is pressed or slid, the button 12 activates the sliding door 6 that slides on the tracks 19 or reels on the upper section and lower section of the flappable door 13, allowing back and forth movement of the sliding door 6.

(g) a track slit or opening 21 located in the center of the top track which allows passage and movement of the button 12. The bottom track supports and guides the movement of the bottom section of the flappable door 13, and the top track supports and guides the movement of the top section of the flappable door 13. The track slit 21 aligns with a lid slit 21 allowing for movement of the button 12 when slid or pressed by user.

(h) A cutter slot 9 which allows tearing of the wipe 16 after passing the opening 5 for removal of the wipe 16 from the device.

(i) Two door snaps 17 or tabs on the flappable door that secure the flappable door 13 to the exterior compartment 4 of the device. One snap 17 is on the upper section of the flappable door 13 and the other snap is on the lower section of the flappable door 13, and the snaps 17 allow the flappable door 13 to be secured to the holes or indentures 18.

(j) A mound 8 or raised plastic to help expose the wipe 16 at the opening 5.

(k) An air closure 11 to seal the cutter slot 9 and the device.

(l) The device may have on its bottom section 10 or outer body of the device a ribbing 15 for gripping the device. (The bottom section 10 is not to be confused with the exterior compartment 4).

DESCRIPTION OF DRAWINGS

Drawings of the Morrisey-Hawkins invention are enclosed to this application.

OPERATION OF INVENTION

Figure 1:
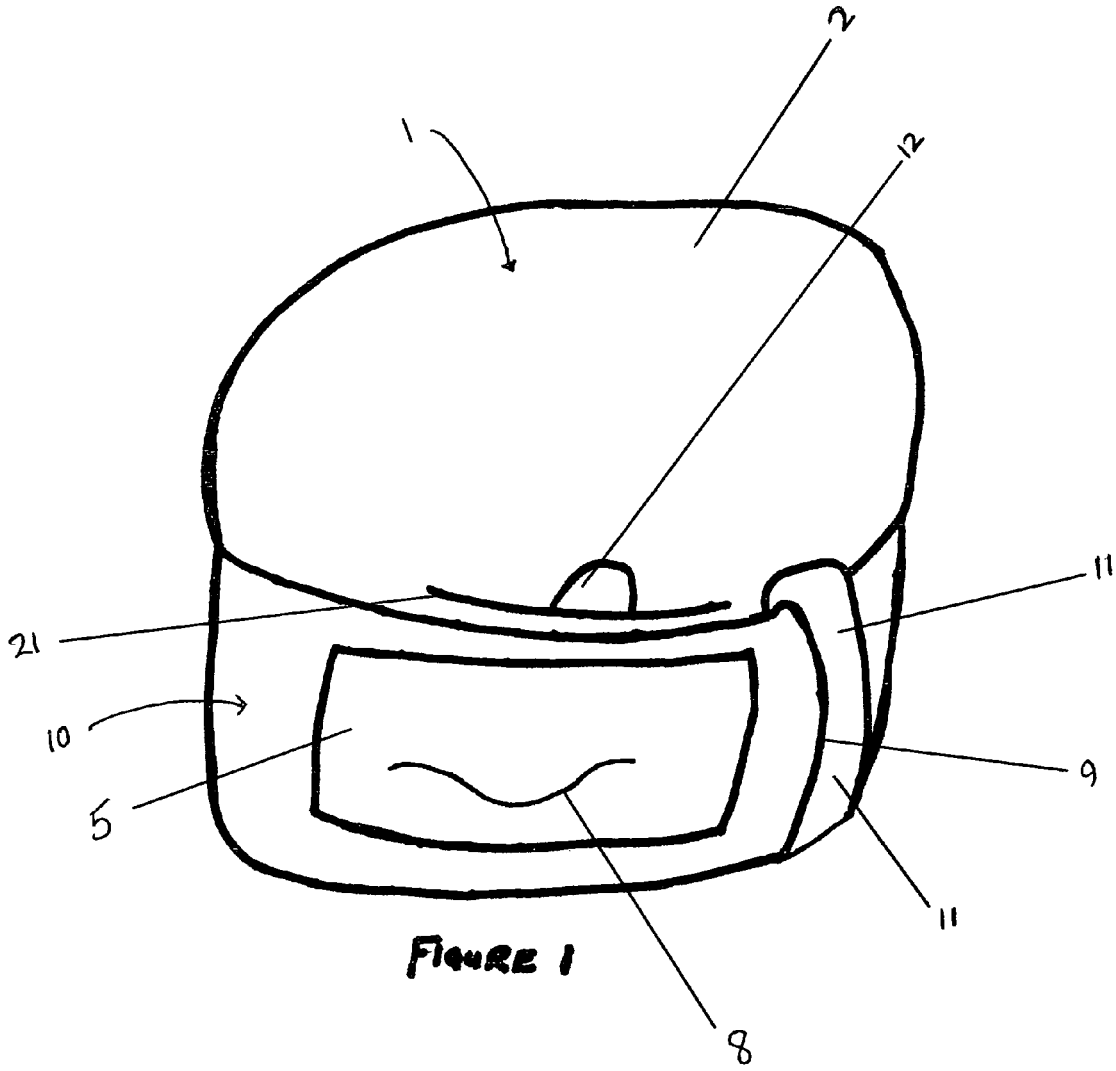
FIG. 1. This is a drawing of the exterior of the wipe dispenser when closed and when the bottom section 10 is secured to the top section 1.
Figure 2:
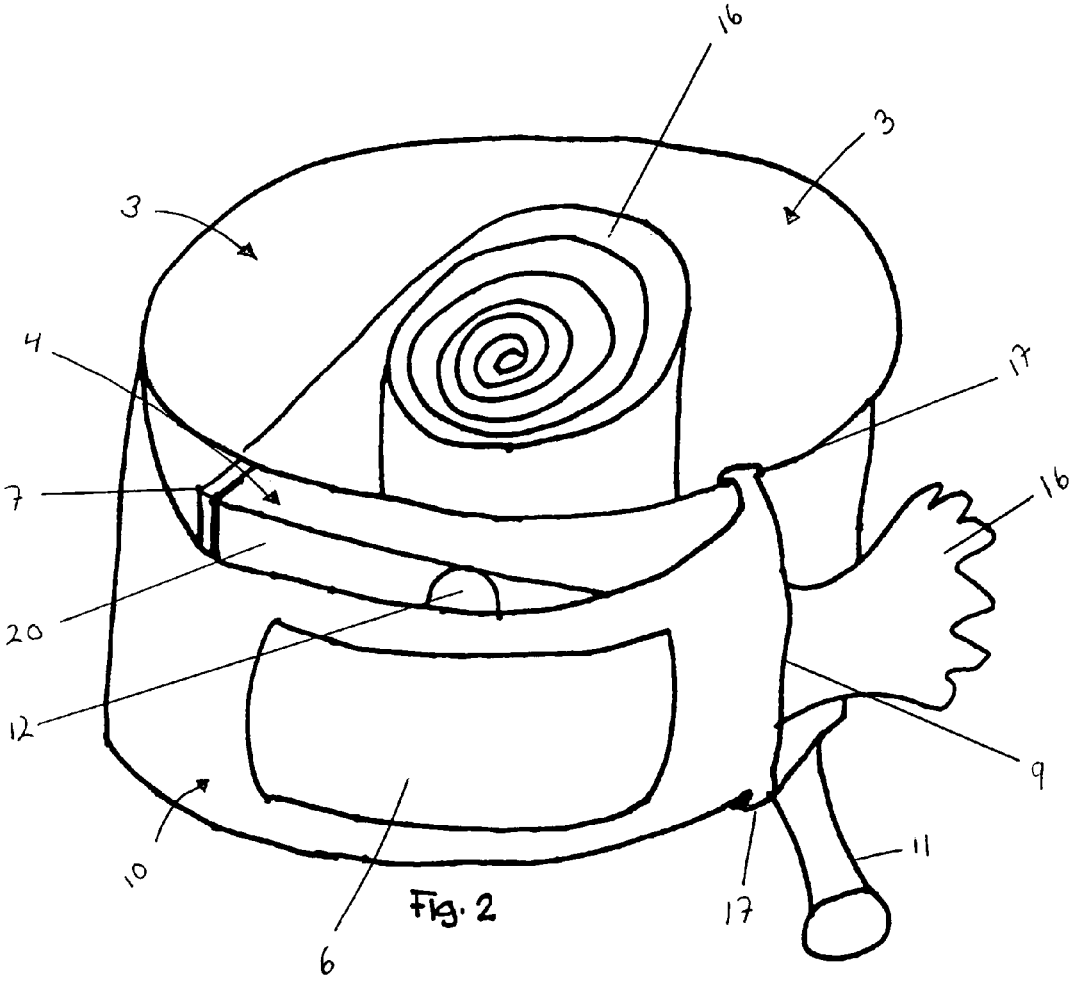
FIG. 2. This is a drawing of the wipe dispenser showing the roll of wipes inside the sealed container, and the special mechanism for their dispensing.
Figures 3A, 3B:
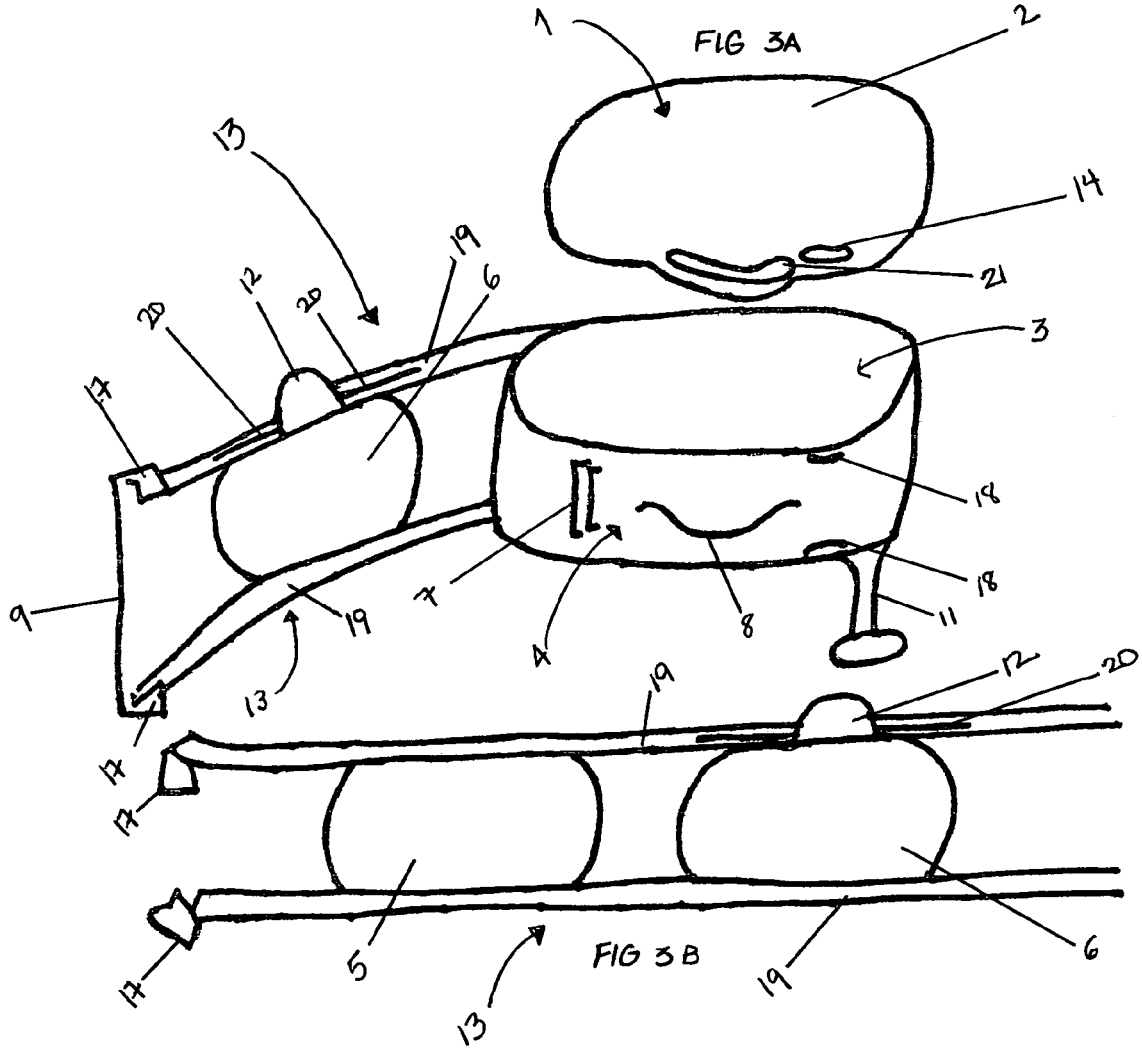
FIG. 3A. This is a drawing of the top section 1 of the device, including the lid 2, the hole or indenture 14 for air closure, and lid slit 21; as well of the exterior compartment 4 including removable window 6 section, including the flappable door 13, amongst other elements.
FIG. 3B. This is a drawing of the flappable door 13 section, illustrating many elements of the device FIG. 4. This is a drawing of a dispenser with ribbing 15 for grip, but with an open window or door 6.
Figure 4:
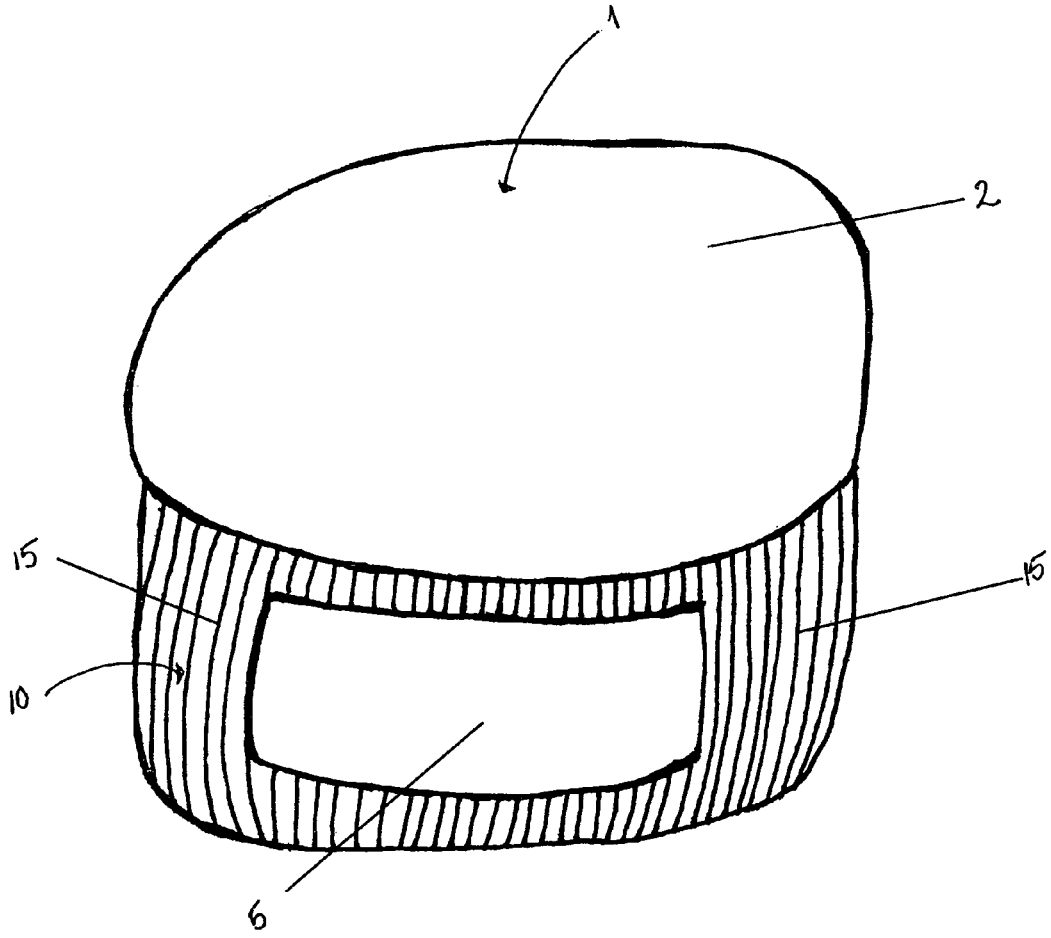

The invention is operated by manually holding the container that contains the sealed wipes, and then individual wipes are then used from the container and passed across the surface of the item to be disinfected. This can be done in a way that does not require the wipe to come into contact with the human hand. The sealed wipes are also kept disinfected because there is no need to open the container.

The method herein described entails that user manually grabs the device, manipulates the button 12 by pressing or sliding it, thereby activating the door 6 or window. This activation entails that the lid slit 21 when aligned with the track slit 20 allows for passage of the button 12 and a back and forth movement of the button 12 and door 6 when pressed or slid by user; and when the button 12 passes through the track slit 20 and lid slit 21 allowing the door 6 to slide on the track slit 20 to open or close the opening 5. When the door 6 or window slides on the track slit 20 exposing the opening 5 and the wipe 16, user can clean a desired surface with the exposed wipe 16 that has been lead from the interior compartment 3 to the exterior compartment 4 via de thread slot 7 and mound 8.

User can also secure the lid 2 to the bottom 10 by placing the door snaps 17 on the holes 18 or indentures, and placing the air closure 11 in the air closure hole 14, thereby completely sealing the device.

After the desired surface is cleaned user may also tear off the wipe 16 at the cutter slot 9, remove it from the device, close the door 6 or window by manipulating the button 12 and activating the sliding door 6 or window, placing the door snaps 17 on the holes 18 or indentures, placing the air closure 11 in the air closure hole 14, thereby sealing the device.

The invention can be used as a mechanism to disinfect and wipe a wide range of items, including, but not limited to, telephone receiver, telephone earpiece, telephone base, cellular phone, hands, desk top, desk accessories, door handles, speakers, keyboards, door knobs, refrigerator, refrigerator handle, countertop, sinks, cabinets, remote controls, etc.

DESCRIPTION AND OPERATION OF ALTERNATIVE EMBODIMENTS

The invention subject of this application may be used in a variety of embodiments. The holder package may be of various materials, may be ornamented in various ways. The wipes may be scented or plain. The wipes may be of various materials, of given strength. Different types of disinfecting material may also be used.

According to one embodiment of the present disclosure the door or window closing the opening is slidable and flappable.

According to one embodiment the bottom of the device is detachable and can be attached to the bottom part of the container for example with screws, adhesives or Velcro.

One embodiment of the present invention is a device with ribbing helping the user to grip the device.

A further embodiment of the present invention is a device with a detachable window section.

The scope of the subject of the invention shall be judged by the claims and not limited to the embodiments described herein.

CONCLUSION, RAMIFICATION & SCOPE OF INVENTION

The scope of the invention described herein is only provided as an example of the same. The above specifications shall not limit the scope of the invention for its scope shall be determined as described within the claims of the invention in this application.

LIST OF REFERENCE NUMERALS

This is not applicable to this application.

SEQUENCE LISTING

This is not applicable to this application

I claim:

1. A handheld device for dispensing wipes, wherein the device is lightweight, portable and disposable, and wherein said device comprises:

a bottom section comprising a first and a second compartment, the first compartment being an interior compartment comprising a moisture impermeable section to hold a supply of wipes, and the supply of wipes that follows a path from the interior compartment and into the second compartment, and the second compartment being an exterior compartment comprising:

a thread slot from the interior compartment to the exterior compartment directing a wipe to pass an opening to expose the wipe, the opening further comprising a section in a flappable door and exposes the wipe to a desired surface, a sliding door that opens and closes the opening allowing exposure of the wipe or sealing of the opening, a flappable door semi-detached from the bottom section, wherein the flappable door has an upper section and a lower section and has a button that sits on tracks and wherein the button activates the sliding door when the button is pressed or slid, the tracks further comprising top tracks on the upper section of the flappable door and bottom tracks in the lower section of the flappable door, wherein the sliding door rests in the tracks, and allows a back and forth movement of the sliding door, and wherein the bottom track supports and guides the movement of the bottom section of the flappable door, and the top track supports and guides the movement of the top section of the flappable door, a track slit comprising an opening on the top track through which the button sits, allowing passage and movement of the button, and wherein the track slit aligns with a lid slit further allowing movement of the button when pressed or slid, a cutter slot which allows tearing of the wipe after passing the opening for removal of the wipe from the device, two door snaps wherein one snap is on the upper section of the flappable door and the other snap is on the lower section of the flappable door, and wherein the snaps allow the flappable door to be secured to holes, two holes for door snaps, wherein each hole is located on an opposite side of the other hole, a mound to help expose the wipe at the opening, and an air closure;

a top section further comprising:

a detachable lid, said lid covering the first compartment and the second compartment of the bottom section, a lid slit wherein when the lid slit is further aligned with the track slit, allowing for passage of the button allowing and a back and forth movement of the button and sliding door when pressed or slid, and wherein when the button passes through the track slit and lid slit allowing the door to slide on the track slit to open or close the opening, and a hole on the lid that allows the air closure to snuggly snap on into the hole thereby sealing the cutter slot and sealing the device.

2. The device described in claim 1, wherein the referred supply of wipes are moistened with a sterilizing material.

3. The device described in claim 1, wherein the wipes are exposed while still attached to said container.

4. The device described in claim 1, wherein the bottom section has a ribbing for gripping the device.

5. The device described in claim 1, wherein the mound comprises raised plastic for helping expose the wipe at the opening.

6. The device described in claim 1 wherein the cutter slot contains a razor edge to allow for cutting of wipe.

7. The device according to claim 1, wherein the sliding door is a window.

8. The device according to claim 1, wherein the holes are indentures.

9. The device according to claim 1, wherein the tracks are reels.

10. The device according to claim 1, wherein the door snaps are tabs.

11. A method for cleaning surfaces using the device described in claim 1, said method comprising the steps of:

a) providing the device of claim 1;

b) a user does not enter into a direct contact with the supply of wipes, for the user manually grabs the device, manipulates the button activating the sliding door, wherein the track slit and the lid slit are aligned allowing the sliding door to slide on the tracks exposing the opening and the wipe, and wherein the user cleans a desired surface with the exposed wipe; and c) after the desired surface is cleaned the user closes the sliding door by manipulating the button, activating the sliding door wherein the track slit and the lid slit are aligned allowing the sliding door to slide on the tracks closing the opening, and having the door snaps in the holes, placing the air closure in the air closure hole, thereby completely sealing the device.

12. The method described in claim 11, wherein the sliding door is a window.

13. The method described in claim 11, wherein the holes are indentures.

14. The method described in claim 11, wherein the tracks are reels.

15. The method described in claim 11, wherein the snaps are tabs.

16. A method for cleaning surfaces using the device described in claim 1, said method comprising the steps of:

a) providing the device of claim 1;

b) a user does not enter into a direct contact with the supply of wipes, for the user manually grabs the device, manipulates the button activating the sliding door, wherein the track slit and the lid slit are aligned allowing the sliding door to slide on the tracks exposing the opening and the wipe, and wherein the user cleans a desired surface with the exposed wipe; and c) after the desired surface is cleaned the user pulls and tears off the wipe at the cutter slot, removes the wipe from the device, and closes the sliding door by manipulating the button, activating the sliding door wherein the track slit and the lid slit are aligned allowing the sliding door to slide on the tracks closing the opening, and having the door snaps in the holes or indentures, placing the air closure in the air closure hole, thereby completely sealing the device.

17. The method described in claim 16, wherein the sliding door is a window.

18. The method described in claim 16, wherein the holes are indentures.

19. The method described in claim 16, wherein the tracks are reels.

20. The method described in claim 16, wherein the snaps are tabs.

* * * * *